US008602920B2

(12) United States Patent
Windsor

(10) Patent No.: US 8,602,920 B2
(45) **Date of Patent: *Dec. 10, 2013**

(54) APPARATUS FOR TRAINING SWING OF A BATTER

(76) Inventor: Steven T. Windsor, Spring, TX (US)

( * ) Notice: Subject to any disclaimer, the term of this patent is extended or adjusted under 35 U.S.C. 154(b) by 303 days.

This patent is subject to a terminal disclaimer.

(21) Appl. No.: 13/084,863

(22) Filed: Apr. 12, 2011

(65) Prior Publication Data

US 2012/0264547 A1 Oct. 18, 2012

(51) Int. Cl.
*A63B 69/00* (2006.01)

(52) U.S. Cl.
USPC ..... 473/453; 473/417

(58) Field of Classification Search
USPC ..... 473/451–453, 417, 418
See application file for complete search history.

(56) References Cited

U.S. PATENT DOCUMENTS

| | | | | | |
|---|---|---|---|---|---|
| 2,985,452 | A * | 5/1961 | Trippet | 473/453 |
| 3,937,464 | A * | 2/1976 | Zalewski | 473/428 |
| 3,940,131 | A * | 2/1976 | St. Claire, Jr. | 473/417 |
| 4,451,036 | A * | 5/1984 | Sinclair et al. | 473/453 |
| 4,516,771 | A * | 5/1985 | Nau | 473/453 |
| 5,029,852 | A * | 7/1991 | Gilfillan | 473/417 |
| 5,087,039 | A * | 2/1992 | Laseke | 473/417 |
| 5,478,070 | A * | 12/1995 | Morrison | 473/419 |
| 5,711,726 | A * | 1/1998 | Powers | 473/453 |
| 6,435,990 | B1 * | 8/2002 | Bradley | 473/453 |
| 7,662,052 | B1 * | 2/2010 | Vidrine | 473/422 |
| D627,411 | S * | 11/2010 | Windsor | D21/780 |
| 2006/0089212 | A1 * | 4/2006 | Marchel | 473/422 |
| 2006/0148597 | A1 * | 7/2006 | Pope et al. | 473/453 |
| 2006/0240917 | A1 * | 10/2006 | Campbell et al. | 473/453 |
| 2007/0129182 | A1 * | 6/2007 | Taylor | 473/422 |
| 2008/0248900 | A1 * | 10/2008 | Hernandez | 473/453 |
| 2009/0227401 | A1 * | 9/2009 | Mauer et al. | 473/451 |

* cited by examiner

*Primary Examiner* — Mark Graham
(74) *Attorney, Agent, or Firm* — Bushman & Associates, P.C.

(57) ABSTRACT

An apparatus for training a batter the proper swing of a bat at a pitched ball. The apparatus has an elongate stem and an arm connected to the stem. The arm has a first, longer run connected to the stem and a second, shorter run interconnected to the first run, the first and second runs forming a swing window in at least one position for use.

20 Claims, 4 Drawing Sheets

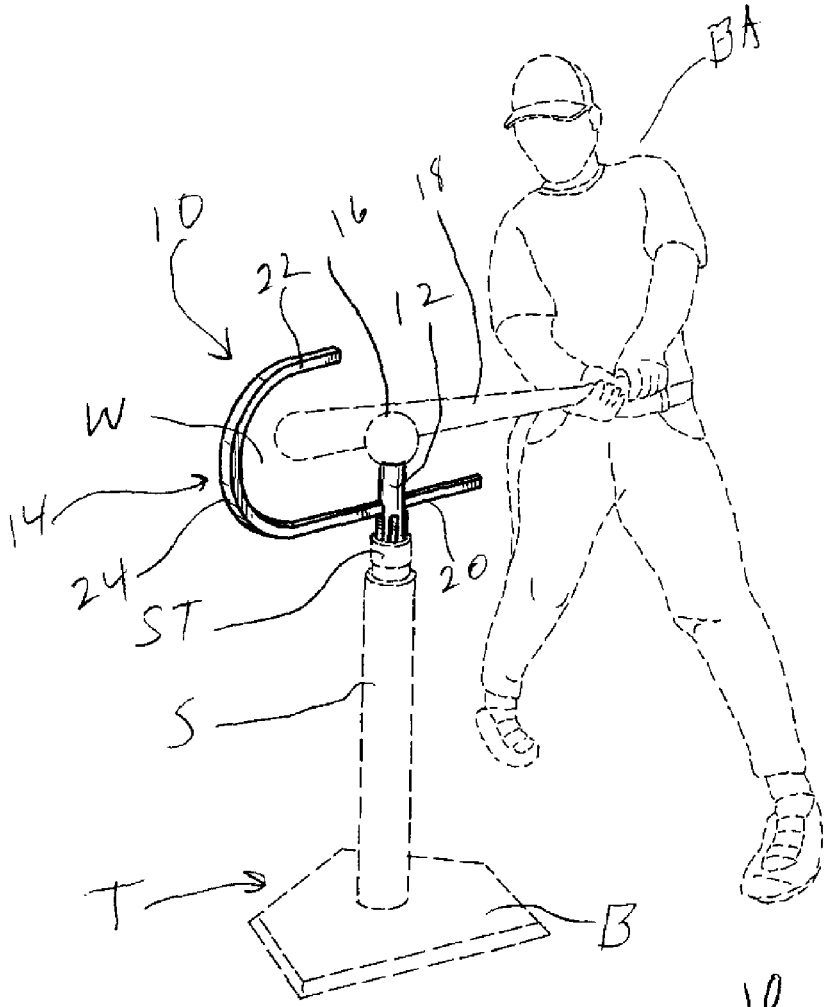
FIG.1
FIG.2
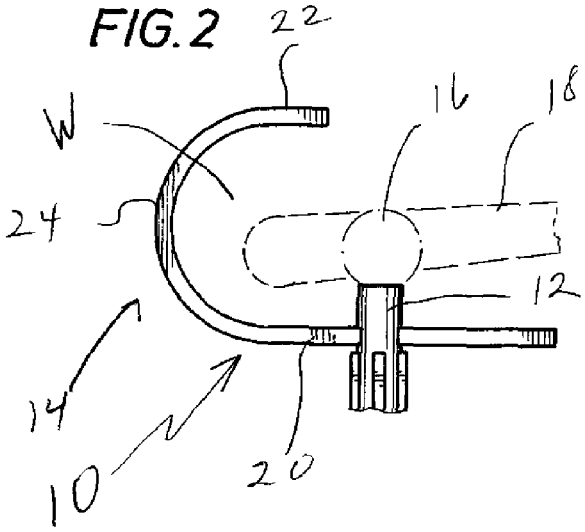
FIG.3
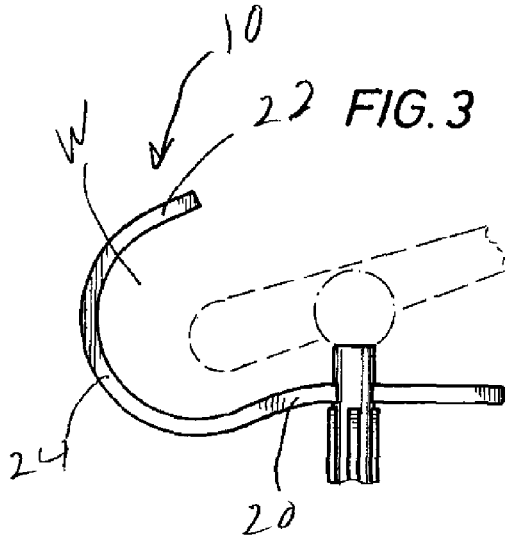

FIG.8
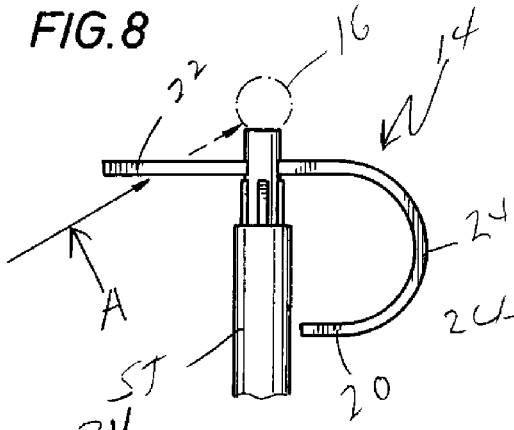
FIG.9
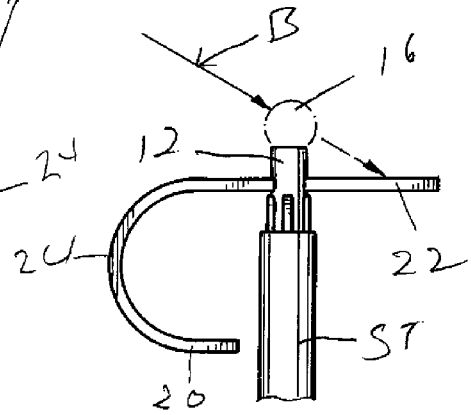
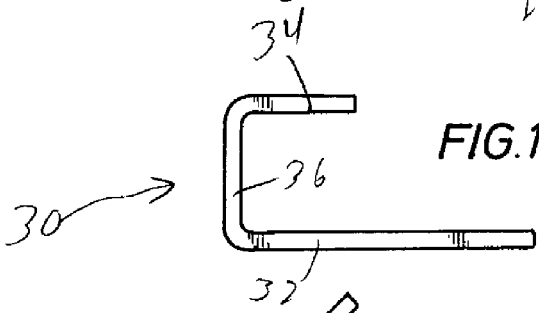
FIG.10
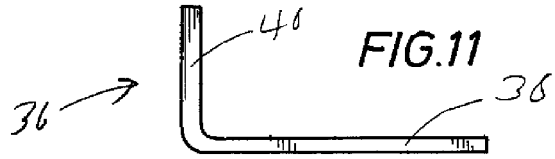
FIG.11
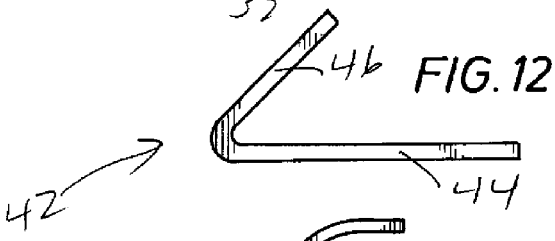
FIG.12
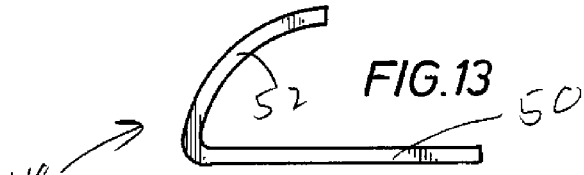
FIG.13
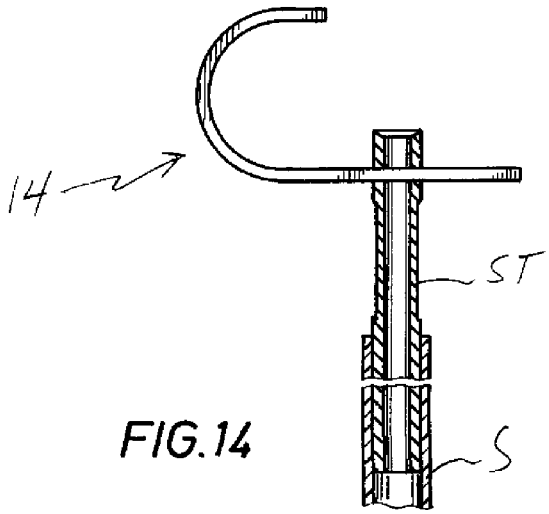
FIG.14
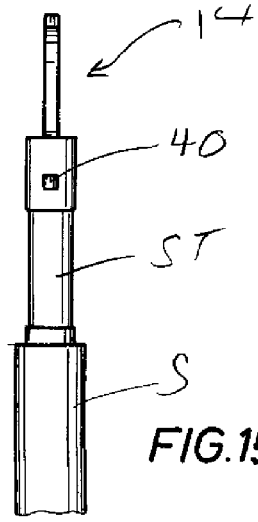
FIG.15

APPARATUS FOR TRAINING SWING OF A BATTER

BACKGROUND OF THE INVENTION

1. Field of the Invention

The present invention relates to apparatus for training the swing of a batter.

2. Description of Prior Art

The use of so-called batting tees for practice in hitting baseballs and softballs is well known from the youngest of players to professional athletes. In the use of a tee, a baseball or softball is supported on a vertical member or stanchion, which has a formation at the top to receive the ball. Generally, the lower end of the vertical member is affixed to a planar support or base replicating the home plate used in baseball or softball. The vertical support member is generally adjustable in height; i.e., it can be a telescoping member, to position the ball over the plate at the desired vertical position; e.g., at approximately the vertical height of a pitched ball relative to the ground as it travels past the batter. In use, the batter assumes a stance adjacent to the base or plate of the batting tee and swings the bat at a ball on the tee, thereby simulating the actions the batter would take in striking a pitched ball.

While batting tees are useful to a certain extent in developing the swing of a baseball/softball player, it falls far short of teaching a batter the desired positioning of the hands relative to the body, as the batter swings the bat to strike the ball.

It is well known in baseball/softball circles that to properly contact a pitched ball to obtain maximum result, both in direction and power, the hands of the batter on the handle of the bat should be ahead of the barrel of the bat just prior to the time the bat makes contact with the pitched ball. This is generally referred to as keeping the hands inside the ball, which generally leads to a short, quick swing, such that the barrel of the bat does not hook around or go outside the ball. This swing requires that the hands stay relatively close to the body to achieve an optimum swing.

SUMMARY OF THE INVENTION

In one aspect, the present invention provides an apparatus for training the swing of a batter.

In yet another aspect, the present invention provides an apparatus for training a batter to keep the hands inside the ball.

In another aspect of the present invention, there is provided an apparatus comprised of a stem and an arm. The arm has a first, longer run and a second, shorter run interconnected to the first run and forms a swing window for a bat to swing through when the apparatus is in at least one position for use Preferably, the second run has an outer end spaced from but overlying the first run. The longer run of the arm is connected, fixedly or removably, to the stem.

BRIEF DESCRIPTION OF DRAWINGS

FIG. 1 is a perspective view showing the apparatus of the present invention mounted on a batting tee in a first position to train the swing of a batter;

FIG. 2 is an enlarged view of a portion of FIG. 1 showing the apparatus in a first position for use;

FIG. 3 is a view similar to FIG. 2 but showing the apparatus modified and in a second position for use;

FIG. 8 is an elevational view showing the apparatus in a third position for use;

FIG. 9 is an elevational view showing the apparatus in a fourth position for use;

FIG. 10 is an elevational view showing another embodiment of the apparatus of the present invention;

FIG. 11 is an elevational view, partly in section, of another embodiment of the present invention;

FIG. 12 is a side view of the apparatus shown in FIG. 11;

FIG. 13 is an elevational view showing another embodiment of the apparatus of the present invention;

FIG. 14 is an elevational view showing another embodiment of the apparatus of the present invention;

FIG. 15 is an elevational view showing another embodiment of the apparatus of the present invention;

DESCRIPTION OF THE PREFERRED EMBODIMENT

Figure 4:
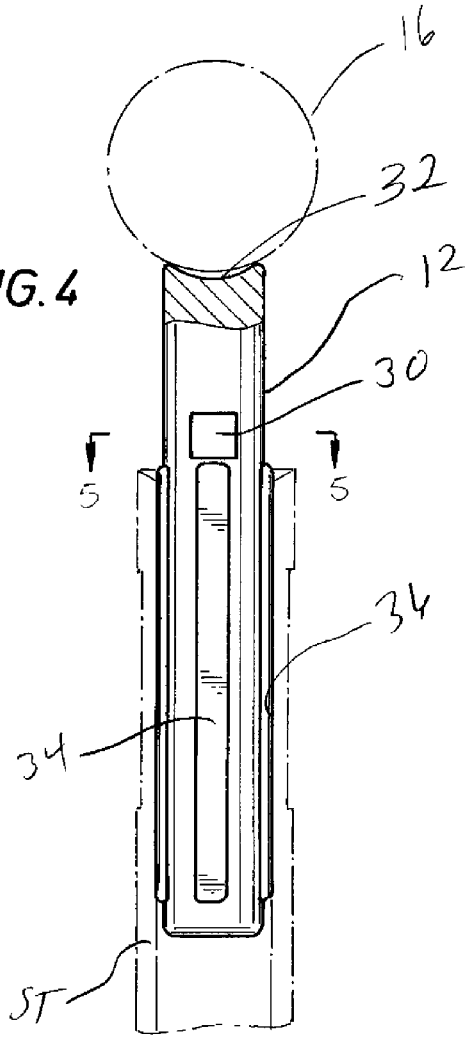
FIG. 4 is an elevational view, partly in section, showing the stem of the apparatus of FIG. 1 mounted in a batting tee.

Referring first to FIG. 1, there is shown a batting tee T comprised of a base B and a generally vertically upwardly extending stanchion S. As is well known, batting tees such as T are often comprised of a telescoping sections, one of which is shown as ST, which is vertically movable relative to stanchion S. Disposed in the upper, open end of telescoping section ST is the apparatus of the present invention shown generally as 10.

Apparatus 10 comprises, in the embodiment shown in FIG. 1, a stem 12 and an arm shown generally as 14 connected to stem 12. Stem 12 fits in the upper, open end of telescoping section ST of stanchion S, while arm 14, described more fully hereafter, slidably extends through an opening in stem 12. As shown in FIG. 1, a ball 16 is positioned on a ball or seating formation formed in the top of stem 12. In the depiction of FIG. 1, a batter BA is shown as swinging a bat 18 striking ball 16, in what would be considered an appropriate swing of batter BA. To this end, arm 14 has a first run or section 20, a second run or section 22, and a third run or section 24 connecting runs 20 and 22. As seen, run 20 is longer than run 22, runs 20 and 22 being axially spaced relative to stem 12 by run 24.

As can be seen in FIG. 1, arm 14 and in particular, runs 20, 22 and 24 form a swing window W comprised generally of the area within the confines of runs 20, 22 and 24, the swing window W, as seen in FIG. 1, opening toward the batter BA. In general, if a line was drawn connecting the ends of runs 20 and 22, the area within the perimeter formed by the runs 20, 22 and 24 and the line would, in general, form the swing window.

In FIG. 2, apparatus 10 is shown in the position to teach a batter how to swing when the ball is thrown in what is commonly referred to as a "belt high pitch."

FIG. 3 shows the apparatus 10 with the runs 20, 22 and 24 repositioned so as to teach a batter how to properly strike a so-called "low pitch." In this regard, it can be seen that the mouth of the swing window W, relative to what is shown in FIG. 2, rather than opening in a generally horizontal direction, opens at a somewhat upward angle.

Figure 5:
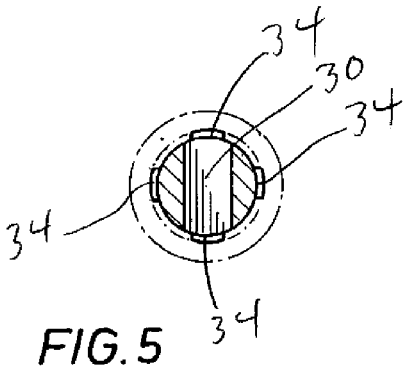
FIG. 5 is a cross-sectional view taken along the lines 5-5 of FIG. 4.

Referring now to FIG. 4, there is shown the details of the stem 12 of the embodiments shown in FIGS. 1-3. Stem 12 is provided with a rectangular opening 30, which extends through stem 12, and which is adapted to receive run 20 of arm 14. Stem 12, on its upper end, is provided with a generally concave recess 32, upon which ball 16 can rest. In the embodiment shown in FIGS. 4 and 5, stem 12 is provided with longitudinally extending ribs 34, which are generally equally circumferentially spaced and extend outwardly from stem 12 to provide a snug fit between stem 12 and the inside wall 36 of telescoping portion ST of the stanchion S. While it is desirable that stem 12, when it is received in the telescoping portion ST of a stanchion S of a conventional batting tee, is rotatable with respect to the stanchion S, it is also desirable that when the stem 12 is rotated to the desired position relative to the stanchion S, that the fit between the stanchion S and stem 12 be snug enough to maintain that position. However, in may cases, ribs such as ribs 34 are unnecessary, and in this regard, reference is made to FIGS. 6 and 7.

Figure 6:
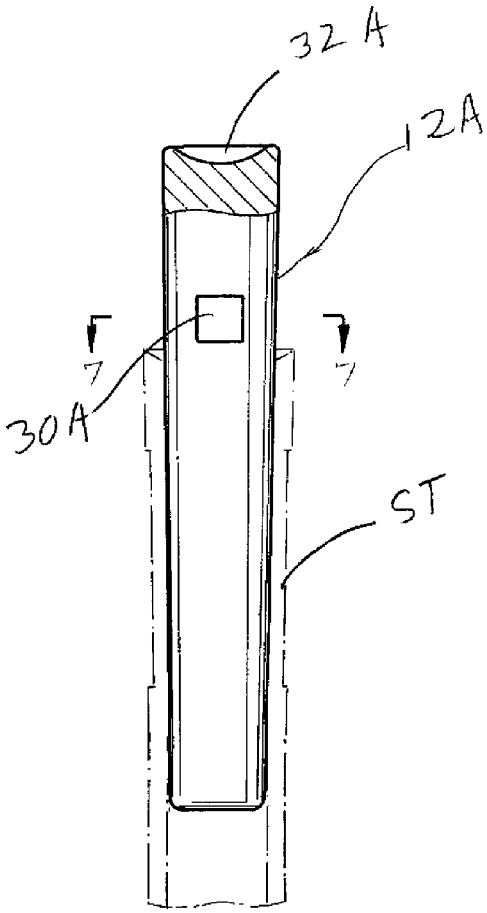
FIG. 6 is an elevational view, partly in section, of another embodiment of the apparatus of the present invention.
Figure 7:
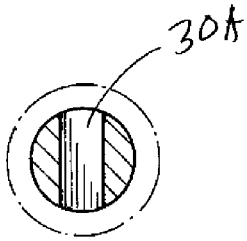
FIG. 7 is a view taken along the lines 7-7 of FIG. 6.

FIGS. 6 and 7 show a slightly modified version of the stem 12. Stem 12A, rather than having longitudinally extending, laterally outwardly projecting ribs 34, is substantially cylindrical, the fit between the telescoping portion ST of the stanchion S and the outside surface of stem 12 forming a generally snug fit, thereby allowing stem 12A to be rotated relative to telescoping portion ST, the snug fit maintaining the stem 12A in the position to which it has been rotated.

FIG. 8 shows the use of the apparatus 10 for indicating to a batter, when the batter is "upper-cutting" at the ball. In this regard, arrow A indicates the trajectory of the bat as it is being swung at the ball 16. When the batter is swinging in this improper manner, the bat will strike run 22 of arm 14 prior to striking ball 16. As seen in the depiction of FIG. 8, the apparatus 10 is arranged to teach a left or right hand batter not to upper-cut the ball. In this regard, the imaginary left hand batter would be positioned such that the bat trajectory would be along arrow A.

Turning now to FIG. 9, again the position shown depicts the swing of a left handed batter and, as depicted by the arrow B, the swing by the batter is what is referred to as "chopping down," and in this regard, while the batter would strike the ball 16, run 22 of run 14 would also be struck, indicating to the batter that he/she was swinging down as opposed to a level swing.

A comparison of FIGS. 1-3, 8 and 9 shows the versatility of the apparatus of the present invention in that in FIG. 2, when the pitch is belt high, if the swing of the batter is proper, the ball will be struck squarely, generally resulting in line drives. In FIG. 3, where the pitch is low, the "sweet spot" of the bat will move at an angle downward to contact the low pitched ball. FIG. 8 shows how the apparatus of the present invention can be used to teach a batter not to swing up in such a manner which would generally result in a "pop up" or other relatively easily caught fly ball. Lastly, when used in the position shown in FIG. 9, the batter can see where he/she is chopping down at the ball resulting in ground balls, not line drives. FIGS. 1-3, 8 and 9 also demonstrate how the apparatus of the present invention can be used in various configurations for both left and right hand batters. For example, with respect to FIG. 1 which depicts a right hand batter, if a left hand batter was depicted in FIG. 1, arm 14 would simply be rotated 180° from the position shown. The apparatus of the present invention, in addition to training a batter, to keep the hands inside the ball, such that the hands are generally relatively close to the body of a batter, can also be used as noted above, to teach the batter not to "cast out" at a pitched ball. In this regard, as it will be recognized by those skilled in the art, the term "cast out" is generally synonymous with terms such as "sweeping," "looping," "swinging around the ball," and "being long to the ball."

Referring now to FIG. 10, there is shown another embodiment of the present invention wherein instead of the J-shaped configuration of arm 14, the arm 30 shown in FIG. 10 is generally in a U-shaped. In this regard, arm 30 has a longer run 32, an axially spaced shorter run 134 and a connecting run 36.

Referring to FIG. 11, there is shown another embodiment of the present invention, wherein the arm 36 is L-shaped having a longer run 38 and a shorter run 40.

In FIG. 12, there is shown another embodiment of the present invention, wherein the arm 42 is generally V-shaped having a longer run 44 and a shorter run 46.

In FIG. 13, the arm 48 has a longer run 50 and a shorter, arched run 52. In the embodiments shown in FIGS. 1-10, 12-13, the swing window is at least partially closed in the sense that the distal end of the shorter run is axially above the longer run as measured, for example, by an imaginary perpendicular line between the distal end of the shorter run and the long axis of the longer run. Stated differently, the distal end of the shorter run overlies at least a portion of the longer run. However, as shown in FIG. 11, the swing run may be defined without the distal end of the shorter run 40 overlying any portion of the longer run 38. While somewhat less effective, as a training aid, the embodiment shown in FIG. 11 would still be effective at defining a swing window. Furthermore, the embodiment shown in FIG. 11 would still be equally effective in training a batter with respect to the training features provided by the embodiments shown in FIGS. 8 and 9.

FIGS. 14 and 15 depict another embodiment of the present invention, wherein rather than using a separate stem such as stem 12, a portion of the stanchion of a conventional batting tee is provided with a through-hole for receipt of the arm. Referring then to FIG. 14, stanchion S having telescoping portion ST of batting tee is depicted. Telescoping section ST has a square or rectangular hole 40 therethrough for receipt of arm 14. Thus, the arm 14 of the present invention can be used either with a stem which can fit into a portion of the stanchion of a conventional batting T or, alternatively, can be connected to a portion of the stanchion of a conventional batting T.

Figure 16:
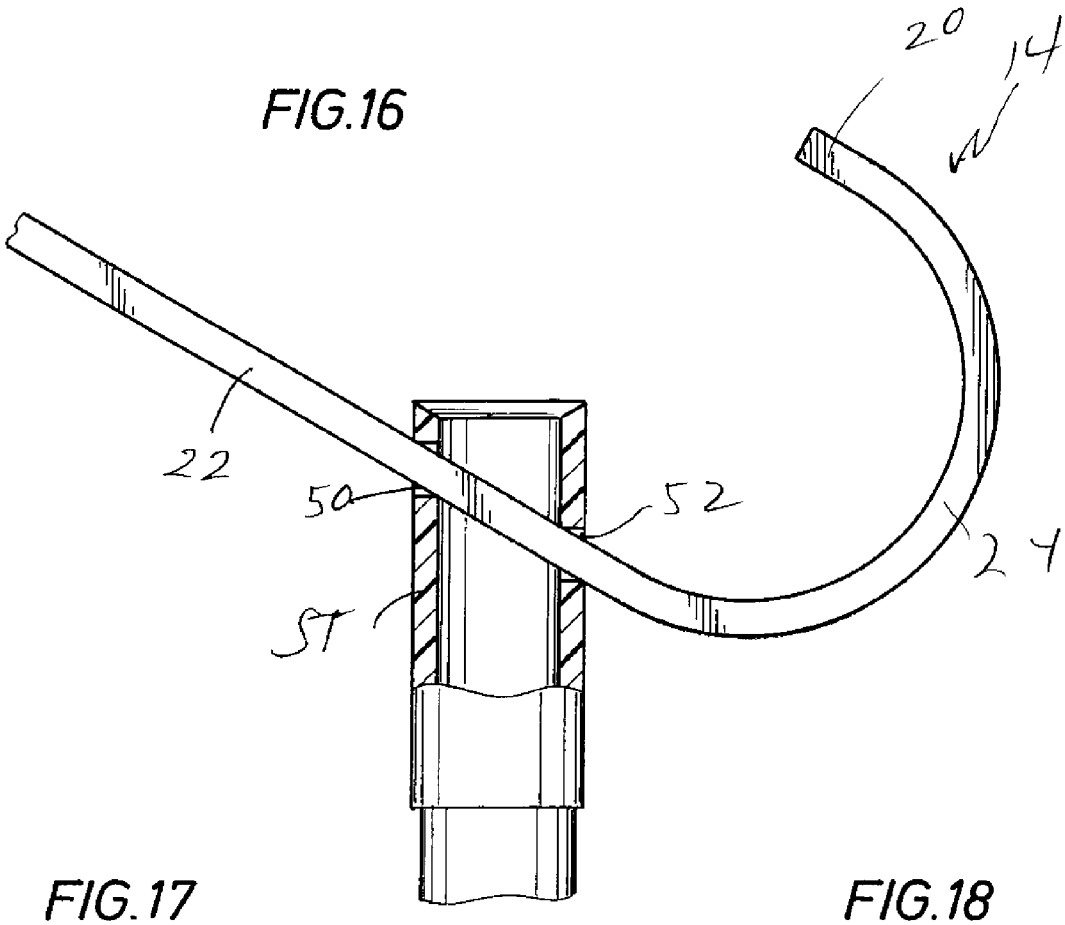
FIG. 16 is an elevational view, partly in section of another embodiment of the apparatus of the present invention.
Figure 17:
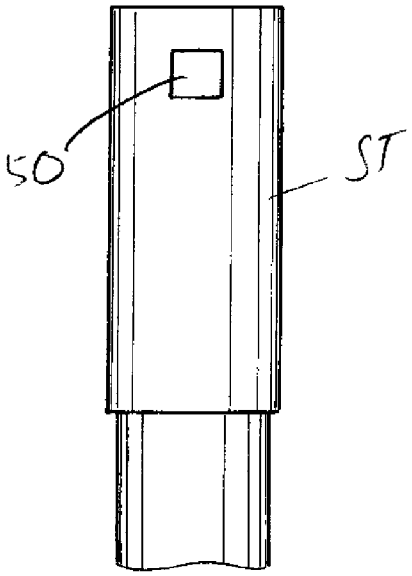
FIG. 17 is an elevational view showing one side of the stem of the apparatus shown in FIG. 16.
Figure 18:
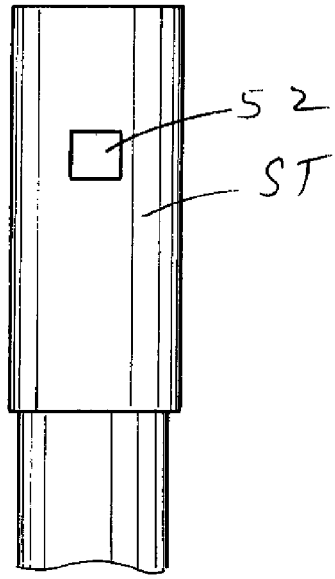
FIG. 18 is an elevational view of a diametrically opposite side of the stem of the apparatus shown in FIG. 16.

FIGS. 16-18 show another embodiment of the present invention, wherein the arm 14 has its longer run extending through the stanchion ST at an angle extending longitudinally through the stanchion ST. The embodiment shown in FIG. 16 accomplishes the same purpose as the embodiment shown in FIG. 3 without the necessity for the arm 14 having to be made out of a flexible or bendable material. The description with respect to the use of the embodiment shown in FIG. 3 is thus equally applicable to the use of the embodiment shown in FIG. 16.

While arm 14 has been generally depicted as having a rectangular; e.g., square cross section, such is not necessary. Although it is desirable that the cross-section of arm 14 be such that if it is connected to the stem by removably sliding it through a hole in the stem, the cross-section of the arm and the the cross-section of the hole would be such as to prevent relative rotation of the arm 14 around the longer run which extends through the hole. However, it is to be understood that such is not necessary; thus, the hole through the stem could be circular, the cross-sectional shape of the arm circular and some means provided; e.g., a rubber grommet in or around the hole in the stem which would allow the circular cross-section arm to be received in the hole and snugly engaged by the resilient, rubber grommet whereby it would not rotate when placed in the proper position. Still further the hole could have a rubber sleeve disposed therein, which would snugly hold the run of the arm extending therethrough. Furthermore, it will be recognized that when the cross-sectional shape of the arm and the cross-sectional shape of the hole in the stem are keyed together so as to prevent rotation, anyone of numerous shapes can be employed.

While in the description above, the apparatus has been described primarily with respect to the arm and the stem being removably attached to one another, it will be understood that the stem and the arm could be fixedly attached to one another. In this regard, the stem and the arm could be molded as a single piece, whether the stem is of the type shown in FIGS. 1-3, where it fits into a conventional batting tee, or if the stanchion or a part thereof of a conventional batting tee forms the stem of the apparatus.

In some cases, it is preferred that the arm 14 be made of a flexible material in the sense that, the arm 14 can be configured to accommodate different purposes in the training of a batter. For example, as can be seen by comparing FIGS. 2 and 3, when the arm 14 is made of flexible material, it can be easily changed from the configuration shown in FIG. 2 to the configuration shown in FIG. 3 and vice versa. However, as noted, the arm need not be made from a plastic or flexible material.

While in the description of the embodiments above, the arm has been described as being removably, slidably receivable through a hole in the stem, whether the stem be a separate piece or whether it forms part of a stanchion of a batting tee, it will be understood that there are other methods by which the arm can be connected to the stem. For example, a bracket could be attached to the side of the stem and the long run of the arm received through the bracket. Furthermore, other attachment methods such as clips, straps, pins, etc. could be used to connect the arm to the outside of the stem. A connector such as a bracket or a hole through the stem is convenient as it makes it easy to adjust the lateral position of the arm relative to the stem.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described are exemplary, and various other substitutions, alterations and modifications, including but not limited to those design alternatives specifically discussed herein, may be made in the practice of the invention without departing from its scope.

What is claimed is:

1. An apparatus for training the proper swing of a bat at a pitched ball comprising:

an elongate stem, said stem having an upper end;

an arm connected to and laterally adjustable relative to said stem, said arm having a first, longer run transverse to and extending through said stem, and a second, shorter run interconnected to said first run, said first and second run cooperating to form a swing window for a bat to swing through when said apparatus is in at least one position for use; and a ball receiving formation on said upper end of said stem, said upper end of said stem extending above said first, longer run.

2. The apparatus of claim 1, wherein said stem is removably mounted on the upper end of the vertical member of a batting tee.

3. The apparatus of claim 2, wherein said stem is received in an open end of said vertical member.

4. This apparatus of claim 1, wherein said arm is fixed against rotation along an axis passing through said first, longer run.

5. The apparatus of claim 1, wherein said arm is generally J-shaped.

6. The apparatus of claim 1, wherein in a first position for use said second, shorter run is above said first, longer run.

7. The apparatus of claim 1, wherein in a second position for use, said first longer run is above said second shorter run.

8. The apparatus of claim 1, wherein said stem forms part of a stanchion of a batting tee.

9. The apparatus of claim 1, wherein said stem has a first end removably mounted on the upper end of the vertical member of a batting tee, and a second end forming a ball receiving formation.

10. The apparatus of claim 9, wherein said stem is rotatable about an axis generally coaxial with said stem.

11. The apparatus of claim 1, wherein said arm is comprised of a plastic material.

12. The apparatus of claim 1, wherein said second run has an outer end, said outer end being axially displaced but overlying the long axis passing through said first run.

13. The apparatus of claim 1, wherein said first and second runs of said arm form a swing window for a bat to swing through.

14. The apparatus of claim 8, wherein said stanchion has at least one telescoping section which is rotatable relative to said stanchion.

15. The apparatus of claim 1, wherein said arm is generally U-shaped.

16. The apparatus of claim 1, wherein said arm is generally L-shaped.

17. The apparatus of claim 1, wherein said first and second runs are directly connected to one another, and said second run forms an angle of less than 90° with said first run.

18. The apparatus of claim 1, wherein said first and second runs are directly connected to one another and said second run forms an arch.

19. The apparatus of claim 1, wherein there is a connecting run interconnecting said first and second runs.

20. The apparatus of claim 1, wherein said longer run extends through said stem at an angle to an axis extending longitudinally through said stem.

* * * * *